United States Patent [19]

Roberts

[11] Patent Number: 5,002,429

[45] Date of Patent: Mar. 26, 1991

[54] EVACUATION HOSE FOR FLUIDS

[76] Inventor: Charles W. Roberts, 5415 Enchanted Timbers, Humble, Tex. 77346

[21] Appl. No.: 281,526

[22] Filed: Dec. 8, 1988

[51] Int. Cl.[5] ..... E02B 11/00

[52] U.S. Cl. ..... 405/43; 239/145

[58] Field of Search ..... 405/36, 43–51; 248/205.2; 15/244.1, 244.4; 52/169.5; 138/114, 115, 118; 239/44, 145

[56] References Cited

U.S. PATENT DOCUMENTS

| | | | |
|---|---|---|---|
| 2,798,768 | 7/1957 | Babin | 405/45 X |
| 3,576,304 | 4/1971 | Gillemot et al. | 248/205.2 |
| 4,016,727 | 4/1977 | Osaka et al. | 405/48 |
| 4,061,272 | 12/1977 | Winston | 405/45 |
| 4,162,863 | 7/1979 | Gaudard et al. | 405/45 |
| 4,188,154 | 2/1980 | Izatt | 405/43 |

FOREIGN PATENT DOCUMENTS

| | | | |
|---|---|---|---|
| 1297040 | 6/1969 | Fed. Rep. of Germany | 405/44 |
| 2610384 | 9/1976 | Fed. Rep. of Germany | 405/43 |

*Primary Examiner*—David H. Corbin

*Attorney, Agent, or Firm*—Richard C. Litman

[57] ABSTRACT

A portable fluid collection and removal apparatus includes an elongated flexible conduit having a generally circular outer wall provided with a perforated flat bottom wall. The inner passageway of the conduit is filled with fluid absorbent material whereby fluid beneath the conduit is drawn upwardly through the perforated bottom wall, into the absorbent material. Wicks leading from the interior fluid absorbent material extend through the flat bottom wall perforations and project outward to expand the area of absorbency by capillary action. Passageways between plural exterior walls transmit auxiliary fluids to warm the conduit to prevent freezing while, a plurality of the conduits may be assembled in a laterally juxtaposed manner to form a blanket.

6 Claims, 1 Drawing Sheet

EVACUATION HOSE FOR FLUIDS

FIELD OF THE INVENTION

This invention relates to an improved apparatus for the removal of fluids trapped in low areas or on flat horizontal surfaces by a combination of capillary action, gravity and if necessary, a suction pump.

BACKGROUND OF THE INVENTION

Removal of fluids which collect in low areas or on flat surfaces is generally accomplished by drying with desiccants, dispensing by sweeping, use of squeegees, brushing or blowing air, and vacuuming or draining away through recessed or subterranean drains. Many of these processes are not automatic and require the attendance of operators. Subterranean drains are ineffective for draining nonporous surfaces through which fluids will not flow. Surface drains require careful attention to surface pitch, and pitch of the drainpipes utilized. Fluids must flow toward the drains and, once in the drains, flow downward and away. Installing a surface drain to correct a standing water situation can be difficult. Draining a low spot on a flat roof or airport surface, for example, may be so expensive as to prohibit it, and yet the water cannot be allowed to stand.

Drying all but the smallest amount of fluid by blotters or desiccants is also expensive, with the added disadvantage that the soaked materials must be removed and disposed of. Continuing use to absorb recurring water is not practical, nor is dispensing it by sweeping, brushing or blowing the fluid away.

Additionally, freezing weather conditions can totally immobilize many drainage systems which rely upon the fluidity of the collected water or other fluid.

In some other instances, the very nature of the collected fluid precludes some of the conventional fluid removal or recovery methods. For example, dangerous liquids such as spilled chemicals dictate the need for special handling by remote means not involving the direct exposure of workmen.

Wick drains have found use for removing contaminants from below ground by inserting these drains into vertically bored holes, pumping chemical agents into the ground and pumping decontaminated water out. The outer wall of the wick drain being porous filter material, solid particles are prevented from entering the inner perforated pipe, thus preventing plugging. However, wick drains are not used above ground, their operation being limited to subterranean applications.

As can be seen none of the present methods for removing fluids from shallow depressions on horizontal surfaces is completely satisfactory. The present invention contemplates a structure which overcomes these problems and provides an efficient, simple and inexpensive means to remove surface fluids.

SUMMARY OF THE INVENTION

In accordance with the present invention, there is provided a flexible conduit having a generally circular outside wall with a flattened perforated bottom wall and including a circular interior cavity filled with a fibrous absorbent material. Means are provided to connect an evacuation pump to the suction or extraction end of the conduit while a cap attached to the other end prevents fluid flow from that end. In this manner, any number of various lengths of such conduit may be provided to allow treating particular situations at hand and, in view of the flexible nature of the conduit, both vertically and laterally, undulating and sinuous wet substrates are readily accommodated.

The main object of this invention is to provide a non-mechanical non-operated means for removing water from the roofs of flattop buildings. This is accomplished in the present invention by the water being absorbed passing through the conduit to its outermost end, which will be the discharge end, that is positioned down the side of a building considerably below the rooftop level, where the water will be discharged by gravity.

Additionally, one of the objects of the present invention is to provide an improved vacuuming apparatus for fluids including a flexible conduit of selective length having one or more bottom openings and an interior chamber containing absorbent material.

Another object of the present invention is to provide a flexible conduit with a plurality of generally circular concentric walls defining an intermediate chamber and an interior chamber and including bottom passageways for admitting fluid into the interior chamber while heated air may be supplied to the intermediate chamber for operating the apparatus during freezing conditions.

Still another object of the present invention is to provide a fluid transmission conduit having an interior chamber containing an absorbent material and with a plurality of fluid-absorbing wicks extending from the interior of the conduit through perforations in a flat bottom face of the conduit to absorb fluid outside the conduit and convey it by capillary action to the interior absorbent material.

Yet another object is to provide each conduit with lateral connecting means whereby a plurality of conduits can be joined in juxtaposition to widen the area of absorption by providing a blanket apparatus and, including manifolds joining the conduit ends to provide a single fluid outlet and attachment for discharge means.

Another object of the present invention is to provide an improved wet vacuum apparatus for removing fluid from shallow depressions in flat surfaces including a flexible conduit capped at one end and leading to a discharge point at the other end, whereby fluid in the depressions is drawn into the conduit interior by capillary action and is absorbed and retained in absorbent material therein, until removed by gravity.

With these and other objects in view as will more readily appear as the nature of the invention is better understood, the invention consists in the novel construction, combination and arrangement of parts hereinafter more fully described, illustrated and claimed.

A preferred and practical embodiment of the invention is shown in the accompanying drawings, in which:

DESCRIPTION OF THE PREFERRED EMBODIMENT

Figure 1:
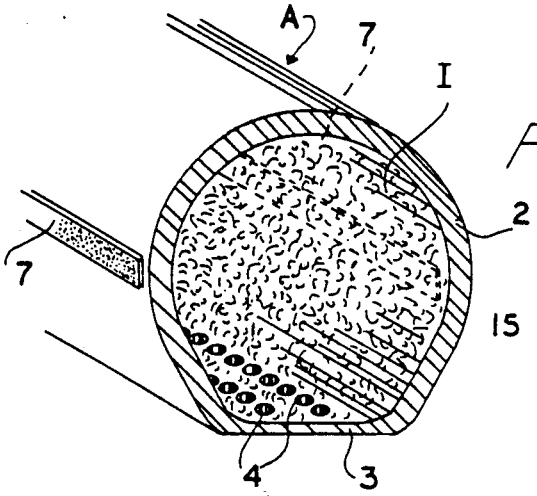
FIG. 1 is a perspective view of a conduit formed in accordance with the concept of the present invention.

Referring now to the drawings, there is shown in FIG. 1 an elongated conduit A comprising a flexible upper wall portion 2, generally circular in shape and having a perforated, flat bottom wall, or face, 3 provided with a plurality of circular or otherwise configured apertures 4. The flat bottom wall 3 will be understood to serve as a base when the conduit A is installed, as by laying one or more lengths across a pool of water as collected upon a relatively flat, horizontal surface. An innermost, or interior passageway I of the conduit is filled with an absorbent material 15 to absorb and retain fluid as drawn thereunto through the apertures 4.

Figure 5:
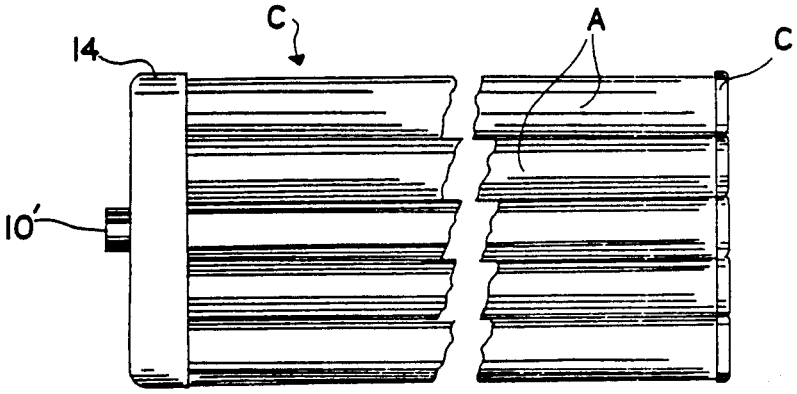
FIG. 5 is a top plan view of a plurality of conduits shown with end caps in place.

It will be appreciated that the conduits are fabricated of inexpensive, lightweight flexible material of any suitable well-known composition, such as plastics. To enhance the flexibility, the conduits may be formed with a convoluted construction such as illustrated in FIG. 5. The property of flexibility allows the conduit bottom wall to more closely conform to any minor vertical and lateral irregularities in the plane of the substrate upon which fluid has collected.

The absorbent material 15 may comprise any suitable, well-known natural or synthetic composition such as cellulose or sponges, which will substantially maintain its volume and not become totally matted and non-porous upon wetting.

The two opposite lateral portions of the wall portion 2 of the conduit are provided with mating fastening components, such as VELCRO, and which will be seen to comprise longitudinal strips disposed along the widest portion of the conduit A. In this manner, any number of selected lengths of conduit A may be laterally joined in a juxtaposed arrangement, to provide a coextensive assembly, or blanket C, as shown in FIG. 5, in order to treat an enlarged wetted area.

Figure 2:
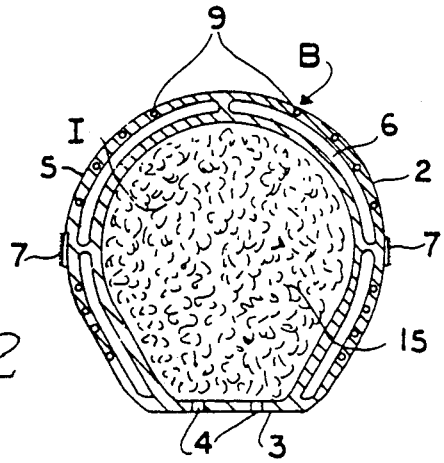
FIG. 2 is a cross-sectional view of a modification of the conduit having a flow passage between two walls.

In the embodiment of FIG. 2, a conduit B is shown wherein, the upper wall portion 2 is provided within the confines of outer wall 5, preferably concentric thereto, and defines an intermediate passageway 6 between the wall 5 and wall 2 for the passage of heated air, as will be described hereinafter, to prevent freezing of the absorbed fluid when the conduit is operated under cold conditions. Struts or webs 5a may be provided between the two walls to preclude collapsing of passageway 6. Additional concentric walls can be incorporated, creating additional passageways for flow of additional fluids. The wall 5 will be perforated as at 9 to allow fluids to enter the inner chamber 6 to expedite fluid evacuation without being absorbed by the absorbent materials 15. These perforations 9 will also allow heated air to pass outward to melt snow, ice, etc.

Figure 3:
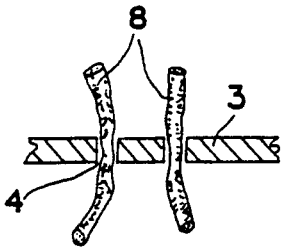
FIG. 3 is an enlarged, fragmentary cross-sectional view of the flat bottom perforated conduit wall.

In FIG. 3, a plurality of flexible wicks 8 of absorbing material, such as cotton, are shown passing from the interior passageway I of conduits A or B through the plurality of apertures 4 in the flat bottom wall 3 and extending a distance outward. Extending the wicks perpendicular to the conduit axis increases the area of absorption of the invention, by draining fluid through the wicks 8 by capillary action and thence into the absorbing material 15 in the conduit interior I. Additionally, with a plurality of such wicks projecting from the entire length of the conduit bottom walls, it will be appreciated that an enhanced absorption may be attained, especially when the underlying substrate contains numerous minor crevices or irregularities containing water that may escape direct contact with the apertured bottom wall 3. Quite obviously, it is envisioned that only a selected number of the apertures 4 may be supplied with wicks 8 such that other of the apertures will remain open to accept the free passage of fluid therethrough.

Figure 4:
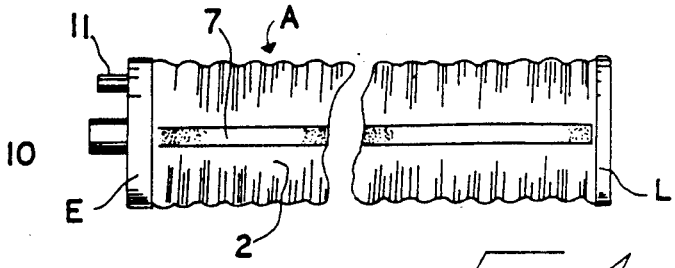
FIG. 4 is a side elevation of the conduit shown with end caps in place.

To utilize the apparatus, one end of a conduit is provided with an extraction end cap E, such as illustrated in FIG. 4. This cap E includes a discharge port 10 to which is attached suitable vacuum or suction means in order to extract from the conduit, fluid collected by the absorbent material 15. In the case of the conduit B, heated air to warm the conduit is admitted through port 11 and thence into the concentric passageway 6, thence circulating through the conduit to warm snow and frozen, adjacent water or prevent collected fluid from freezing.

A leading or terminal end cap L on the opposite end of the conduit serves to seal off the interior passage I to encourage the maximum suction through the apertures 4. Other end cap configurations are also envisioned to adapt the conduit to a variety of applications.

When an assembly of a plurality of conduits A or B are employed to form the blanket arrangement of FIG. 5 a common, or manifold extraction end cap 14 is preferably utilized with but a single discharge port 10' for connection to the source of vacuum. The other, or leading ends of the conduits may be provided with an end cap member 12 as in FIG. 5. The fastening means 7 will be understood to join the plurality of conduits in a laterally juxtaposed manner.

In the preferred embodiment, the walls of the conduit are formed as a corrugated structure transverse to the conduit axis and extending along its length, such as depicted in FIG. 4. Other flexible wall configurations are acceptable, such as a spiral wound, wire-reinforced plastic tube of the type used in tank vacuum cleaners. The conduit is preferably constructed of flexible plastic material which is readily formed inexpensively. As the conduit may be installed permanently, such as in a low spot on a flat roof, durability and ease of installation are desirable as well as low cost.

In many installations wherein the present invention will be used, no external mechanical involvement will be necessary to insure continued operation of the evacuation system. This is due to the fact that the influence of gravity is the only force required to maintain movement of collected water from the discharge end of the tube(s). The most common example of such an operation will be wherein the system is employed upon a flat roof, in which case the discharge end of the elongated tube(s) will extend over the roof edge and down the side of the associated building. In this manner, a natural suction will be provided by the depending member, thus carrying away water absorbed within the tubes disposed upon the roof or other elevated flat surface. These depending tube portions may quite obviously be disposed within existing vertical drains pipes or the like when such are available.

I claim:

1. A flexible conduit for water absorption and drainage comprising:

and elongated tube having a partially circular upper wall portion of fluid impervious flexible material and joined to a substantially flat bottom wall, said tube having opposite ends and defining an innermost passage therein;

said bottom wall provided with apertures therethrough;

absorbing means substantially filling said innermost passage to absorb and retain fluids drawn through said apertures as said tube bottom wall is disposed upon a substrate containing water thereupon;

wick means extending through selected ones of said apertures adapted to convey fluid from externally of said tube bottom wall to said absorbing means, and one said tube end defining a discharge end whereby, fluid collected by said absorbing means in said innermost passage is directed to and through said discharge end.

2. The conduit of claim 1, wherein:

said wick means comprises a plurality of elongated wicks having one end disposed externally of said bottom wall and an opposite end engaging said absorbing means.

3. The conduit of claim 1, including:

fastening means on said tube outer wall cooperating with mating fastening means on similar ones of said tubes to join a plurality of tubes in lateral juxtaposition; and manifold means engageable with one said end of all said plurality of tubes.

4. The apparatus of claim 3, wherein:

said fastening means comprises strips of Velcro extending longitudinally of said tube upper wall portions.

5. The conduit of claim 1, including:

an inner wall disposed within said outer wall and uniformly spaced therefrom to define an intermediate passage; and means at one end of said tube supplying temperature regulating air to said intermediate passage.

6. The conduit of claim 5, including holes in said outer wall permitting exhaust of said temperature regulating air from said intermediate passage.

* * * * *